United States Patent [19]

Mohacsi et al.

[11] 4,357,879

[45] Nov. 9, 1982

[54] AIR SPRINGING BOGIE TRACTION LINK SUSPENSION

[75] Inventors: Sandor Mohacsi, Nuremberg; Theodor Hammen, Rosstal; Walter Schmid, Nuremberg, all of Fed. Rep. of Germany

[73] Assignee: MAN Maschinenfabrik Augsburg-Nuernberg AG, Nuremberg, Fed. Rep. of Germany

[21] Appl. No.: 96,000

[22] Filed: Nov. 20, 1979

[30] Foreign Application Priority Data

Nov. 24, 1978 [DE] Fed. Rep. of Germany ..... 2850878

[51] Int. Cl.[3] ..... B61F 5/10; B61F 5/20; B61F 5/52

[52] U.S. Cl. ..... 105/199 R; 105/199 A; 105/199 F; 105/202

[58] Field of Search ..... 105/199 A, 199 F, 199 R, 105/202

[56] References Cited

U.S. PATENT DOCUMENTS

| | | | |
|---|---|---|---|
| 2,934,028 | 4/1960 | Travilla | 105/199 R |
| 3,045,998 | 7/1962 | Hirst | 105/199 A X |
| 3,121,402 | 2/1964 | Julien | 105/199 F X |
| 3,402,679 | 9/1968 | Christian et al. | 105/199 R |
| 3,570,408 | 3/1971 | Lich | 105/199 R X |
| 4,134,343 | 1/1979 | Jackson | 105/199 R X |
| 4,173,933 | 11/1979 | Kayserling | 105/199 R X |

FOREIGN PATENT DOCUMENTS

| | | | |
|---|---|---|---|
| 862617 | 1/1953 | Fed. Rep. of Germany | 105/182 R |

*Primary Examiner*—Joseph F. Peters, Jr.
*Assistant Examiner*—Howard Beltran
*Attorney, Agent, or Firm*—Karl H. Gross

[57] ABSTRACT

A bolsterless bogie for rail vehicles has at least one link which is directly connected to the bogie frame and the rail vehicle center pivot by means of wear-free rubber joints and connecting pins. Rubber buffers limit the transverse motion between center pivot and bogie frame; vertical forces are transmitted by air-spring bellows arranged in the vehicle center plane between the underframe and the bogie side sill, and stops effective in the travel direction are provided between center pivot and bogie frame.

5 Claims, 7 Drawing Figures

AIR SPRINGING BOGIE TRACTION LINK SUSPENSION

BACKGROUND OF THE INVENTION

This invention relates to a bolsterless bogie with air suspension for rail vehicles where an underframe is connected directly by a center pivot and wear-free link to a bogie frame without the intermediary of a bolster beam.

A bogie is known where the underframe is directly linked via the centre pivot through the intermediary of two links each to the bogie. Both links have wear-free joints with one link being arranged horizontally in the direction of travel, whereas the other link is also disposed horizontally but transverse to the direction of travel. The former link will transmit the draw and buffing forces, whereas the latter link is designed to transmit the transverse forces. The region of the plane in which the links are connected to the centre pivot is situated directly below the underframe and appreciably above the level of the axles. Spring action is provided by leaf springs which cushion the swing bolster against the bogie frame.

A bogie arrangement of this type is not only obsolete because of the type of secondary suspension provided and unsuitable for high-speed rail vehicles, but it is also disadvantageous in the way and manner the bogie is linked to the underframe. This drawback is to be seen in the fact that the links are arranged a great distance above the plane of the axles of the wheels. Especially in the case of driving bogies, this tends to displace the wheel loads in a most undesirable manner during acceleration and deceleration, causing skidding or spinning of individual wheel-and-axle sets. Secondly, any pitching motions of the bogie inevitably tend to be transmitted via the center pivot to the car body and to make themselves felt in a detrimental manner in the form of flexural oscillations of the car body and shuttling oscillations. A further disadvantage of this type of connection is to be seen in the unfavourable stressing under extreme operating conditions such as are liable to occur when the cars collide with considerable impact during shunting. Under such conditions, high inertia forces will be transmitted solely by the links and these will be stressed far beyond their normal operating conditions for short periods. This calls for the links to be overdimensioned with a resultant increase in cost.

SUMMARY OF THE INVENTION

In contrast to this, the present invention has as an object to provide a bogie arrangement which, in particular in respect of the method of linking it to the underframe and with regard to a secondary suspension acting in conjunction with it, will avoid said disadvantages and meet the requirements for high-speed capability.

This object is achieved in accordance with the present invention by effecting the connection by at least one link which is disposed horizontally and is joined to the center pivot and bogie frame in the direction of travel, preferably at the level of the axle boxes and in that the pins of the joints supported in wear-free rubber joints are arranged horizontally and transverse to the travel direction and in that the limitation of lateral motions between the center pivot and the surrounding bogie frame is effected by rubber buffers while vertical forces are transmitted by means of air spring bellows arranged at the transverse center plane between the underframe and the bogie side sill, and further in that the center pivot and the bogie frame are provided with stops which are effective in the travel direction.

An arrangement of this type offers the advantage that, due to the low-level connection in the region of the ideal pitching point, approximately at the level of the axles of the wheels, any pitching motions of the bogie frame will not be transmitted as flexural oscillations and as shuttling oscillations as a result of the long leverages where the connection is far outside the axle plane to the car body. Another advantage of the low-level connection resides, especially in the case of driving bogies, in the fact that acceleration and deceleration are not liable to cause undesirable excessive unloading of wheel-and-axle sets with the associated phenomenon of wheel spin or skidding. The low-level connection is possible only by the omission of the redundant swing bolster. In order to permit the links to be constructed with minimum dimensions for the sake of space and cost savings, stops are proposed to be provided between the center pivot and the bogie frame which ensure that the links are only required to transmit the forces occurring in normal operation. These consist of the usual draw and braking forces. If these forces should be temporarily exceeded by the cars running against each other vehemently during shunting, the said stops will become effective, in other words, any forces which exceed the normal level will not be transmitted through the link but will be absorbed by the proposed stops. In conjunction with the longitudinal link, an air spring bellows is proposed to provide secondary suspension which also will take care of the re-centering forces in the transverse direction and, thereby, eliminate the need for separate transverse links. Moreover, the air spring bellows are capable of providing control of the car body level. If the permissible side swing should be exceeded, the center pivot will contact rubber buffers which are fixed laterally on the surrounding bogie frame.

BRIEF DESCRIPTION OF THE DRAWING

A number of typical embodiments of the invention are illustrated in the accompanying drawings, in which.

DESCRIPTION OF PREFERRED EMBODIMENTS

Figure 1:
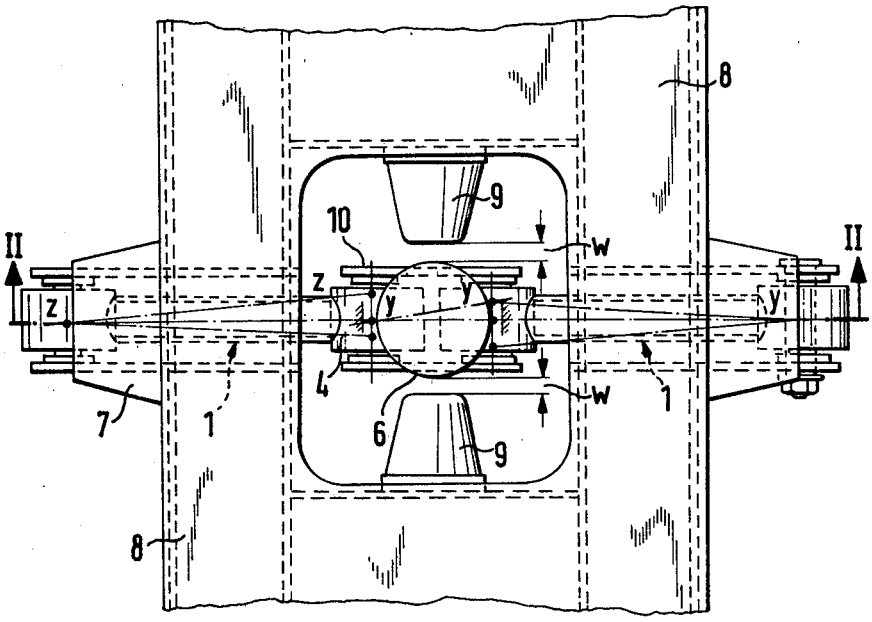
FIG. 1 is a plan view of the center pivot connection with links.

FIG. 1 shows an embodiment of the bogie connection by means of two links 1. In the region of the level of the axle boxes 2, whose level is indicated by the dash-dot line x—x in FIG. 2, the links 1 are connected by means of wear-free rubber joints 3 horizontally in the longitudinal center plane at one side by means of pins 4 to the center pivot 6 attached to the underframe 5 whereas at the other end they are connected by means of the bracket 7 to the transoms 8 which are of hollow box construction to the bogie frame. Stops 9 are provided to limit the permissible side movement, said stops consisting of rubber buffers which are solidly connected to the bogie frame. Before a permissible side motion w is exceeded, the plane contact faces 10 of the center pivot 6 will bear against these buffers and the transverse movement 2 will be flexibly limited. When running in curves, the bogie will rotate slightly with the links 1 being obliquely positioned and the rubber joints 3 slightly deformed. The position of the right-hand link when running in curves is shown by the dashed line y—y in FIG. 1 whereas the dashed line z—z of the opposing link shows its position during lateral impacts.

Figure 2:
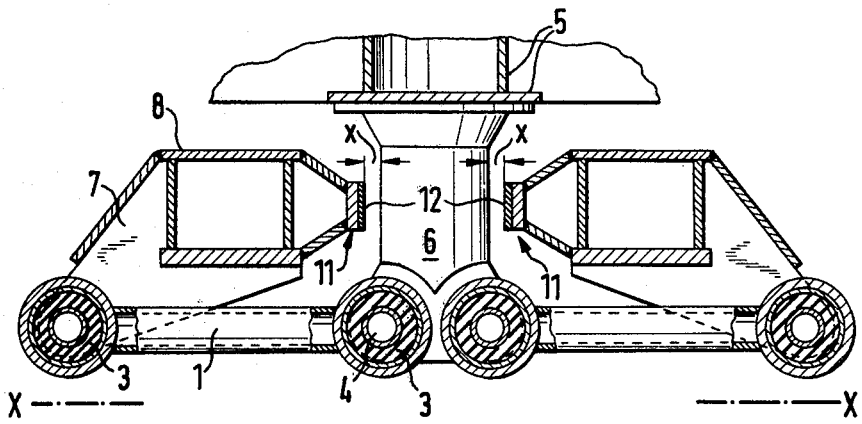
FIG. 2 is a section along the line II—II through the longitudinal center plane of the bogie showing the links connected to the center pivot.

In the event of the forces to be transmitted by the links 1 to the centre pivot 6 exceeding a permissible value, such as in the case of an impact, the stops 11 will become effective as can be seen from FIG. 2. The transmission of forces will be effected directly by the transom 8 of the bogie frame via the stops 11 to the center pivot 6 which will pass on the force to the underframe 5. The links will only be subjected to the force which results from the spring stiffness of the rubber joints 3 when the longitudinal play x between the stop 11 and the center pivot 6 is fully taken up. This fact permits a decrease in the dimensions of the links compared to conventional designs because the maximum amount of forces to be transmitted can be reduced to exactly definable design features. In order to dampen to some extent the impacts of the center pivot 6 against the stops 11, there is provided a layer 12 of high stiffness.

Figure 4:
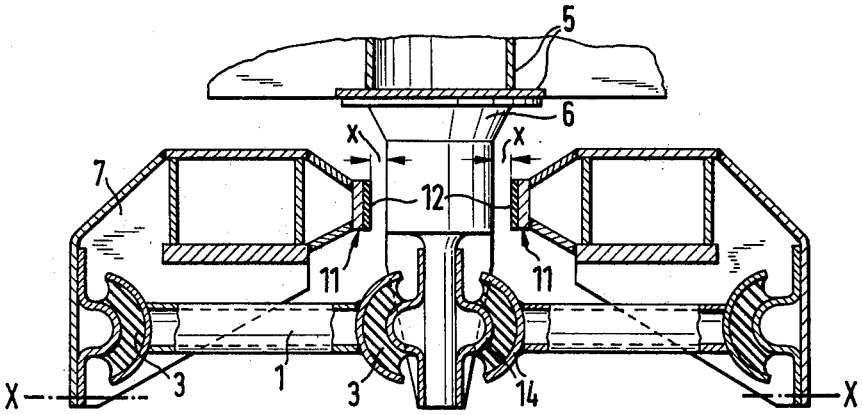
FIG. 4 is a section along the line IV—IV through the longitudinal center plane of the bogie showing the method of joining the links by means of hemi-spherical elements.
Figure 3:
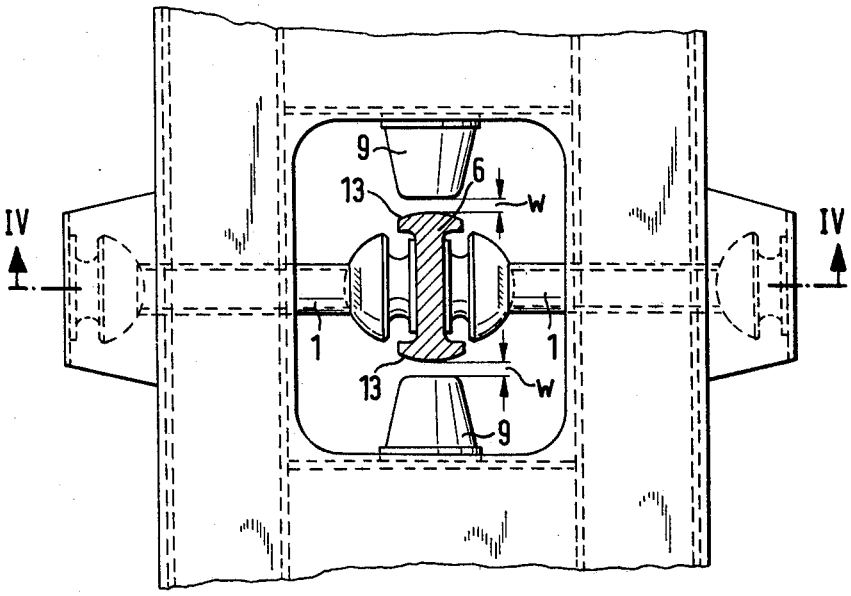
FIG. 3 is a plan view of the center pivot connection by means of two links as well as hemi-spherical joints.

An embodiment of the links 1 according to claim 3 is illustrated in FIGS. 3, 4. FIG. 3 shows the method of connection in plan view. One can see the opposed links 1 and the center pivot 6 which is formed with stops 13 which cooperate with stops 9 which, in turn, consist of rubber buffers which are solidly connected to the bogie frame. The special design of the wear-free joints 3 is shown in Section IV—IV in FIG. 4. The joints consist of hemi-spherical rubber elements which are bonded to hemi-spherical shells 14 of the same shape. In order to limit the forces acting on the links, there are again provided effective stops 11 in the travel direction against which the centre pivot 6 bears when the longitudinal clearance x is exceeded. Again, to dampen the impact, there is a layer 12 of high stiffness.

Figure 6:
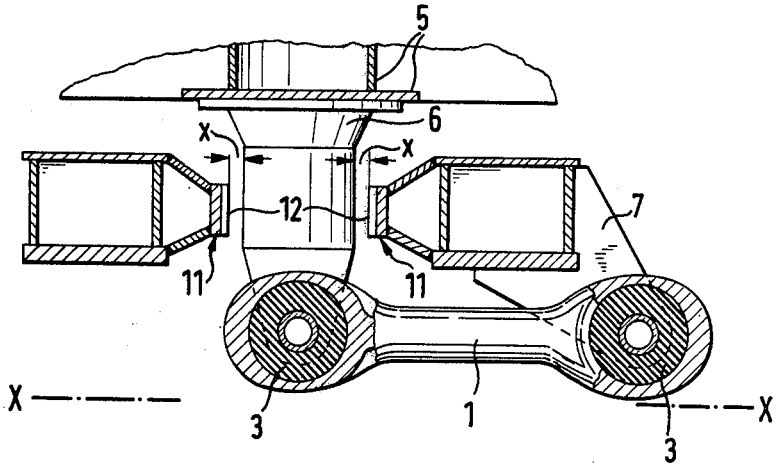
FIG. 6 is a section along the line VI—VI through the longitudinal center plane of the bogie.
Figure 5:
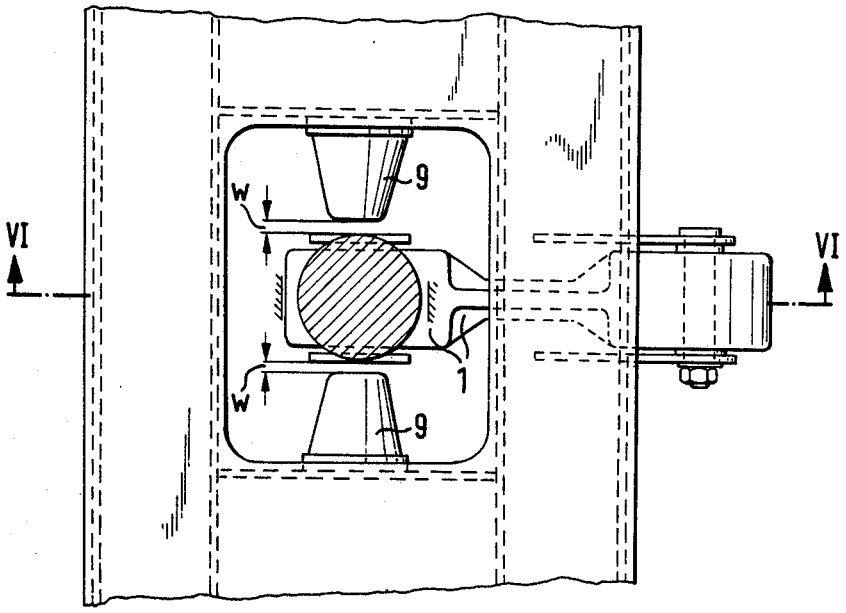
FIG. 5 is a plan view of the center pivot connection with only one link.

A further embodiment of the method of connection is illustrated in FIGS. 5, 6. This form of bogie connection relies on only one link 1. FIG. 5 shows a plan view of the connection with only one link 1 disposed in the longitudinal center plane with lateral stops 9 which are formed by rubber buffers.

FIG. 6 shows a longitudinal section along the line VI—VI in which can be seen the links 1 supported in wear-free cylindrical rubber joints 3 as well as the stops 11 with a layer 12 to dampen the impact limiting the longitudinal play x.

Figure 7:
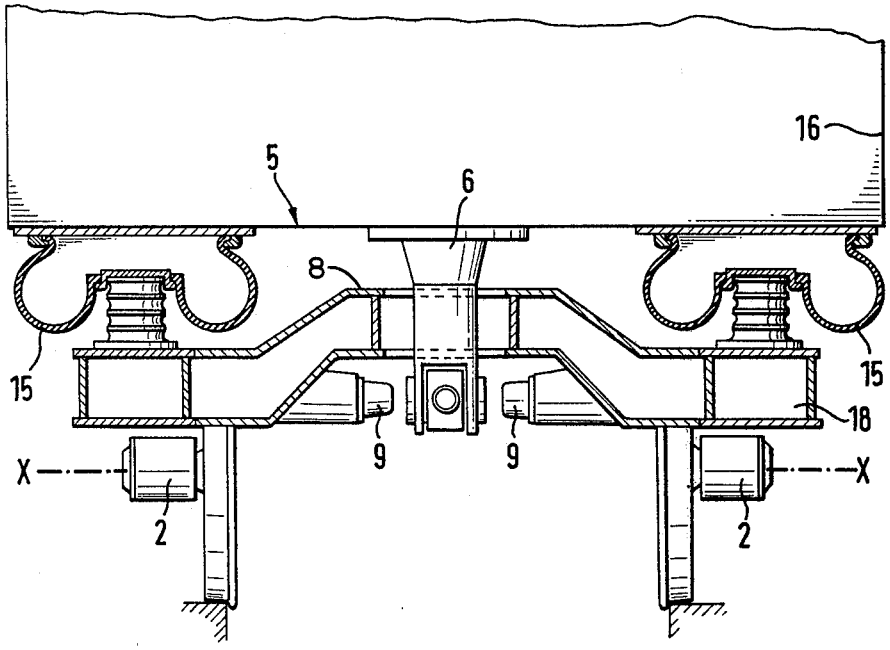
FIG. 7 is a transverse section through the center transverse plane of the bogie frame showing the method of connection to the center pivot and the air spring suspension.

FIG. 7 shows a section through the bogie in the transverse center plane in which the side spring action by means of air springs 15 on side frame 18 in combination with the bogie connection is shown. The connection of the center pivot may be according to any of the disclosed embodiments.

As can be seen, it is the level of the connection in the vicinity of the axle level which avoids pitching motions of the bogie from being transmitted by flexural or shuttling oscillations to the car body because the point of connection coincides with the imaginary axis of the pitching motion. The air spring offers an advantage in that it permits levelling control of the car body and, at the same time, assists lateral guidance. In order to prevent undue side swing, stops 9 are provided on the transom 8.

The invention has hereinbefore been illustrated by way of exemplary embodiments. However, modifications and variations will offer themselves and are intended to be encompassed within the scope of the appended claims.

We claim:

1. A bolsterless bogie for use in rail vehicles having an underframe provided with a center pivot, comprising
   - a bogie frame having a transom;
   - air spring bellows arranged in a transverse center plane between said underframe and said bogie frame;
   - at least one link directly connecting said transom with said center pivot, said link being disposed horizontally and extending lengthwise of the travel direction of the rail vehicle;
   - rubber joints disposed horizontally and transversely to said travel direction, respectively;
   - said rubber joints connecting said link with said bogie frame and said center pivot;
   - means for transmitting relative motion between said center pivot and said bogie frame, including rubber buffers in the horizontal plane of the links and limiting relative transverse motion between said center pivot and said bogie frame; and
   - stops on said transom spaced above said rubber joints effective in said travel direction of said rail vehicle and interposed between said center pivot and said bogie frame.

2. A bolsterless bogie as defined in claim 1, having axle boxes and said link being located at a level above said axle boxes.

3. A bolsterless bogie as defined in claim 1, wherein said rubber joints are formed as cylindrical bushings; and pins extending through said bushings.

4. A bolsterless bogie as defined in claim 1, and further comprising an additional link, said links being arranged in said longitudinal center plane in a direction opposite to said travel direction, said links having ends connected to said center pivot via said joints; and further comprising a bracket connecting said links to said transom.

5. A bolsterless bogie as defined in claim 4, wherein said rubber joints are configurated as hollow spheres, said links each having two ends and said center pivot and the transom having counterparts thereto, said ends and counterparts being configurated as shells in form of hollow spheres, and rubber elements sandwiched therebetween in the manner of silent blocks.

* * * * *